US006021819A

United States Patent [19]

Cannell

[11] Patent Number: 6,021,819

[45] Date of Patent: Feb. 8, 2000

[54] DESIGN AND CONSTRUCTION OF MONOTUBE STEAM GENERATORS

[76] Inventor: Cyril Cannell, The Shipyard, Mill Road, Peel, Isle of Mann, United Kingdom, UK IM5 1TB

[21] Appl. No.: 09/052,004

[22] Filed: Mar. 31, 1998

[51] Int. Cl.[7] ..... F16L 9/00

[52] U.S. Cl. ..... 138/177

[58] Field of Search ..... 122/512, 31.1, 122/32, 250; 60/39.55; 165/134.1; 138/33, 38, 112, 113; 431/114; 376/317

[56] References Cited

U.S. PATENT DOCUMENTS

| | | | |
|---|---|---|---|
| 3,563,211 | 2/1971 | Hornbostel, Jr. | 122/250 |
| 4,156,127 | 5/1979 | Sako et al. | 138/33 |
| 4,303,826 | 12/1981 | Ando | 138/33 |
| 4,429,213 | 1/1984 | Mathieu | 138/33 |
| 5,197,518 | 3/1993 | Ziu | 138/113 |

FOREIGN PATENT DOCUMENTS

| | | | |
|---|---|---|---|
| 2317943 | 10/1996 | United Kingdom | F22B 29/06 |

*Primary Examiner*—Andres Kashnikow
*Assistant Examiner*—Davis Huy

[57] ABSTRACT

A monotube steam generator, the pressure element or elements of which are comprised of tube of partially flattened section, enclosed within mainly close fitting substantially solid metal encasements with generally flat surfaces.

6 Claims, 1 Drawing Sheet

DESIGN AND CONSTRUCTION OF MONOTUBE STEAM GENERATORS

CROSS-REFERENCE TO RELATED APPLICATIONS

Not Applicable.

STATEMENT REGARDING FEDERALLY SPONSERED RESEARCH OR DEVELOPMENT.

Not Applicable.

REFERENCE TO A MICROFICHE APPENDIX.

Not Applicable.

BACKGROUND OF THE INVENTION

This invention relates to improvements in the design and construction of Monotube Steam Generators.

Steam has been a major source of power for more than two centuries, but latterly has to a large extent been supplanted by the internal combustion engine and electricity, especially in the field of transport. However, steam is still widely used in electrical power generation, with oil or solid fuel being the prime energy source, whilst heat produced by nuclear reactors is also employed for this purpose. Conventional boilers of the firetube or watertube type when operating contain large quantities of water at high temperatures and pressures, with potential danger in the event of structural failure. Locomotive boilers are most usually of the firetube type, whilst the watertube variety are widely employed in the marine field and in electricity generating stations.

Because of the considerable danger in event of structural failure, the design and construction of conventional boilers is subject to strict controls and legislation, with stringent initial and periodic inspections and testing being almost universally required for insurance purposes, thus both high constructional and operating costs prevail. An alternative to conventional boilers is the monotube steam generator, wherein steam is only produced as and when needed, from just the required quantity of water. However, their use has been limited for certain technical reasons, in spite of their considerable asset of inherent safety, the object of this invention is to overcome some of these technical disadvantages.

BRIEF SUMMARY OF THE INVENTION

This invention is directed to enabling Monotube Steam Generators to be employed as direct replacements for conventional steam boilers. As the latter contain relatively large quantities of water, together with the necessary substantial metal structure to contain it, they have the benefit of a resulting proportionally high thermal capacity. Whilst this is of no particular asset if heated by gas or readily controlled oil burners, a large thermal capacity is a practical operating requirement if solid fuel or less immediately controllable oil burners are employed, to compensate for the fluctuations in heat output common to both. By contrast, monotube steam generators most usually have both a low structure mass and water content, the proportionally low thermal capacity rendering them unsuitable to employ with fluctuating heat sources, since the quality of steam output would not be practically acceptable for normal purposes. This invention enables whatever degree of thermal capacity required, to be readily provided at comparatively low material and construction cost, by encasing partially flattened tube or tubular elements with mainly flat section solid metal.

DETAILED DESCRIPTION OF THE INVENTION

Figure 1:
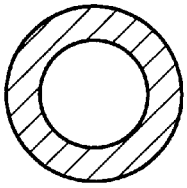
FIG. 1 shows the cross-section of tube commonly specified for the generating elements of monotube steam generators currently in production and use.
Figure 2:
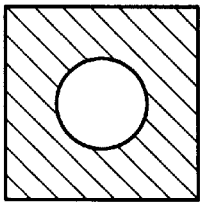
FIGS. 2 and 3 illustrate sections of elements once employed with solid fuel fired monotube steam generators, quite successful but expensive to manufacture.
Figure 3:
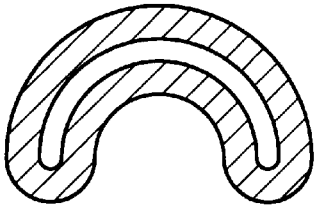
Figure 4:
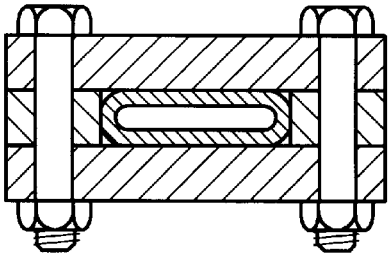
FIG. 4 is a specific embodiment of this invention, utilising bolted or riveted construction, whilst
Figure 5:
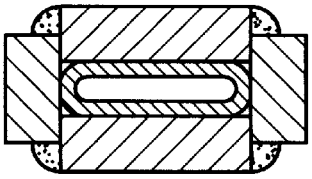
FIG. 5 is of the welded alternative, both shown in sectional form.
Figure 6:
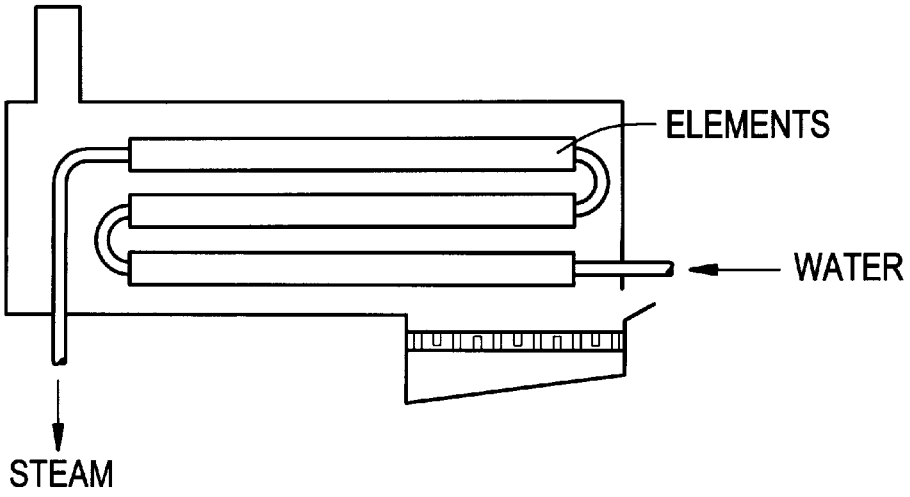
FIG. 6 is a diagram of a monotube steam generator, to which this invention directly relates, as shown for the purpose of original or replacement equipment for locomotives, traction engines or small steam powered marine craft.

Monotube steam generators are conventionally equipped with pressure elements consisting of tubes of circular cross-section, or of special formation, sometimes in separate sections coupled together. This invention provides a pressure element for monotube steam generators consisting of a tube of partially flattened section enclosed within a close fitting encasement of substantially solid metal with generally flat surfaces. These encasements may be of bolted or riveted construction, or more conveniently of welded fabrication using relatively low cost material ie. common grade mild steel for example.

The degree to which the enclosed tube is flattened may be chosen to provide varying cross-sections as required for the desired water/steam flow pattern from inlet to outlet of the generating system. Internal steam/water pressure will ensure close contact and therefore good heat transfer between the partially flattened tubes and the outer encasements. The generally flat encasements provide superior absorbing surfaces from the heat source compared to conventional circular section tubes, and also protection against localised overheating of the internal tubes. Whatever degree of heat storage and steam temperature output equilisation and stabilisation that may be required, can be provided by the mass and thermal capacity of the metal specified for the encasements. This factor enables the use of lees immediately controllable heat sources, such as solid fuel furnaces and some types of oil burners.

Separate generating elements formed in the manner described may conveniently be coupled together in the form of a grid or nest, to provide a monotube steam generator of whatever output capacity that is required, and spaced according to the designed gas flow area from the heat source.

The invention is defined in the following claims.

I claim:

1. A pressure element for monotube steam generators comprising a tube of partially flattened section, and an encasement of substantially solid heat conducting metal with generally flat surfaces, said encasement surrounding at least a portion and being in heat conductive contact with said tube whereby said encasement prevents localized overheating of said tube.

2. A pressure element as claimed in claim 1 wherein said encasement comprises generally flat portions on opposite faces of said tube in heat transfer contact with said partially flattened section and spacing members interconnecting said flat portions.

3. A pressure element as claimed in claim 2 further comprising bolts interconnecting the components of said encasement.

4. A pressure element as claimed in claim 2 wherein said encasement components are welded together.

5. A pressure element as claimed in claim 2 wherein said tube is elongated and partially flattened for a substantial portion of its length.

6. A pressure element as claimed in claim 2, wherein said encasement is formed from mild steel.

* * * * *